US006394565B1

(12) United States Patent
Greenhalgh

(10) Patent No.: US 6,394,565 B1
(45) Date of Patent: May 28, 2002

(54) STORAGE LOCKER DEVICE

(76) Inventor: Angelika Greenhalgh, 3108 Johnson Cir., Bridgewater, NJ (US) 08807

( * ) Notice: Subject to any disclaimer, the term of this patent is extended or adjusted under 35 U.S.C. 154(b) by 0 days.

(21) Appl. No.: 09/737,795

(22) Filed: Dec. 15, 2000

(51) Int. Cl.[7] ..... A47B 81/00
(52) U.S. Cl. ..... 312/285; 312/249.2
(58) Field of Search ..... 312/283, 285, 312/286, 249.2, 125, 135, 107, 108, 9.45, 9.46

(56) References Cited

U.S. PATENT DOCUMENTS

| | | | | | |
|---|---|---|---|---|---|
| 565,779 | A | * | 8/1896 | Murray | 312/125 X |
| 1,123,638 | A | * | 1/1915 | Wingett | 312/285 X |
| 1,242,235 | A | * | 10/1917 | Polk | 312/249.2 X |
| 1,330,181 | A | * | 2/1920 | Gibbs | 312/285 X |
| 1,510,772 | A | * | 10/1924 | Eubank | 312/249.2 X |
| D99,607 | S | | 5/1936 | Scurlock | |
| 2,847,265 | A | * | 8/1958 | Kulik | 312/285 X |
| D262,418 | S | | 12/1981 | Biondi et al. | |
| 4,304,188 | A | | 12/1981 | Gulbrandsen | |
| 4,348,967 | A | | 9/1982 | Schattner et al. | |
| 5,449,230 | A | | 9/1995 | Murray | |
| 5,701,988 | A | | 12/1997 | Tsukada | |

* cited by examiner

*Primary Examiner*—James O. Hansen

(57) ABSTRACT

A storage locker device for storing personal small personal items in a high traffic area. The storage locker device includes a housing defined by a plurality of compartments securely coupled together. The housing has a top side, a bottom side, a first side, a second side, a third side, and a fourth side. The housing is divided into a plurality of tiers. Each of the tiers is comprised of a plurality of compartments securely coupled together. Each of the compartments comprises an outer wall defining a door for providing access into the compartment. The door is hingedly coupled to the compartment. A lock selectively locks the door in a closed position. The lock is mechanically coupled to the door.

7 Claims, 4 Drawing Sheets

STORAGE LOCKER DEVICE

BACKGROUND OF THE INVENTION

1. Field of the Invention

The present invention relates to storage lockers and more particularly pertains to a new storage locker device for storing personal small personal items in a high traffic area.

2. Description of the Prior Art

The use of storage lockers is known in the prior art. More specifically, storage lockers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,449,230; U.S. Pat. No. 4,348,967; U.S. Des. Pat. No. 262,418; U.S. Pat. No. 5,701,988; U.S. Pat. No. 4,304,188; and U.S. Des. Pat. No. 99,607.

While these devices fulfill their respective, particular objectives and requirements, the aforementioned patents do not disclose a new storage locker device. The inventive device includes a housing defined by a plurality of compartments securely coupled together. The housing has a top side, a bottom side, a first side, a second side, a third side, and a fourth side. The housing is divided into a plurality of tiers. Each of the tiers is comprised of a plurality of compartments securely coupled together. Each of the compartments comprises an outer wall defining a door for providing access into the compartment. The door is hingedly coupled to the compartment. A lock for selectively locks the door in a closed position. The lock is mechanically coupled to the door.

In these respects, the storage locker device according to the present invention substantially departs from the conventional concepts and designs of the prior art, and in so doing provides an apparatus primarily developed for the purpose of storing personal small personal items in a high traffic area.

SUMMARY OF THE INVENTION

In view of the foregoing disadvantages inherent in the known types of storage lockers now present in the prior art, the present invention provides a new storage locker device construction wherein the same can be utilized for storing personal small personal items in a high traffic area.

The general purpose of the present invention, which will be described subsequently in greater detail, is to provide a new storage locker device apparatus and method which has many of the advantages of the storage lockers mentioned heretofore and many novel features that result in a new storage locker device which is not anticipated, rendered obvious, suggested, or even implied by any of the prior art storage lockers, either alone or in any combination thereof.

To attain this, the present invention generally comprises a housing defined by a plurality of compartments securely coupled together. The housing has a top side, a bottom side, a first side, a second side, a third side, and a fourth side. The housing is divided into a plurality of tiers. Each of the tiers is comprised of a plurality of compartments securely coupled together. Each of the compartments comprises an outer wall defining a door for providing access into the compartment. The door is hingedly coupled to the compartment. A lock for selectively locks the door in a closed position. The lock is mechanically coupled to the door.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new storage locker device apparatus and method which has many of the advantages of the storage lockers mentioned heretofore and many novel features that result in a new storage locker device which is not anticipated, rendered obvious, suggested, or even implied by any of the prior art storage lockers, either alone or in any combination thereof.

It is another object of the present invention to provide a new storage locker device which may be easily and efficiently manufactured and marketed.

It is a further object of the present invention to provide a new storage locker device which is of a durable and reliable construction.

An even further object of the present invention is to provide a new storage locker device which is susceptible of a low cost of manufacture with regard to both materials and labor, and which accordingly is then susceptible of low prices of sale to the consuming public, thereby making such storage locker device economically available to the buying public.

Still yet another object of the present invention is to provide a new storage locker device which provides in the apparatuses and methods of the prior art some of the advantages thereof, while simultaneously overcoming some of the disadvantages normally associated therewith.

Still another object of the present invention is to provide a new storage locker device for storing personal small personal items in a high traffic area.

Yet another object of the present invention is to provide a new storage locker device which includes a housing defined by a plurality of compartments securely coupled together. The housing has a top side, a bottom side, a first side, a second side, a third side, and a fourth side. The housing is divided into a plurality of tiers. Each of the tiers is comprised of a plurality of compartments securely coupled together. Each of the compartments comprises an outer wall defining a door for providing access into the compartment. The door is hingedly coupled to the compartment. A lock for selectively locks the door in a closed position. The lock is mechanically coupled to the door.

Still yet another object of the present invention is to provide a new storage locker device that may be positioned in a nightclub or such for securely storing items such as keys and wallets to prevent their loss or theft.

Even still another object of the present invention is to provide a new storage locker device that is pivotally mounted on a pedestal so that all sides of the device may hold compartments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
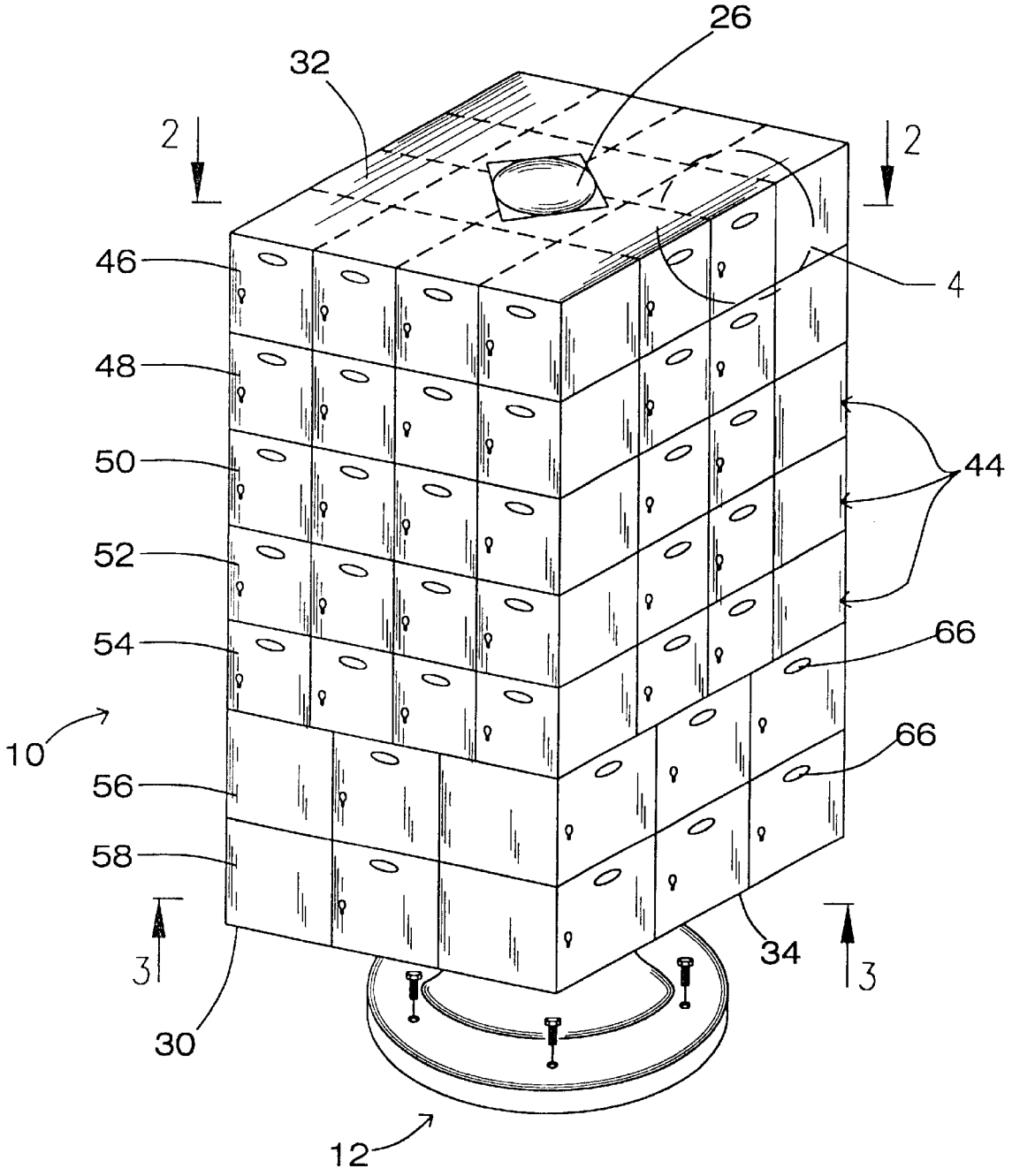
FIG. 1 is a schematic perspective view of a new storage locker device according to the present invention.
Figure 2:
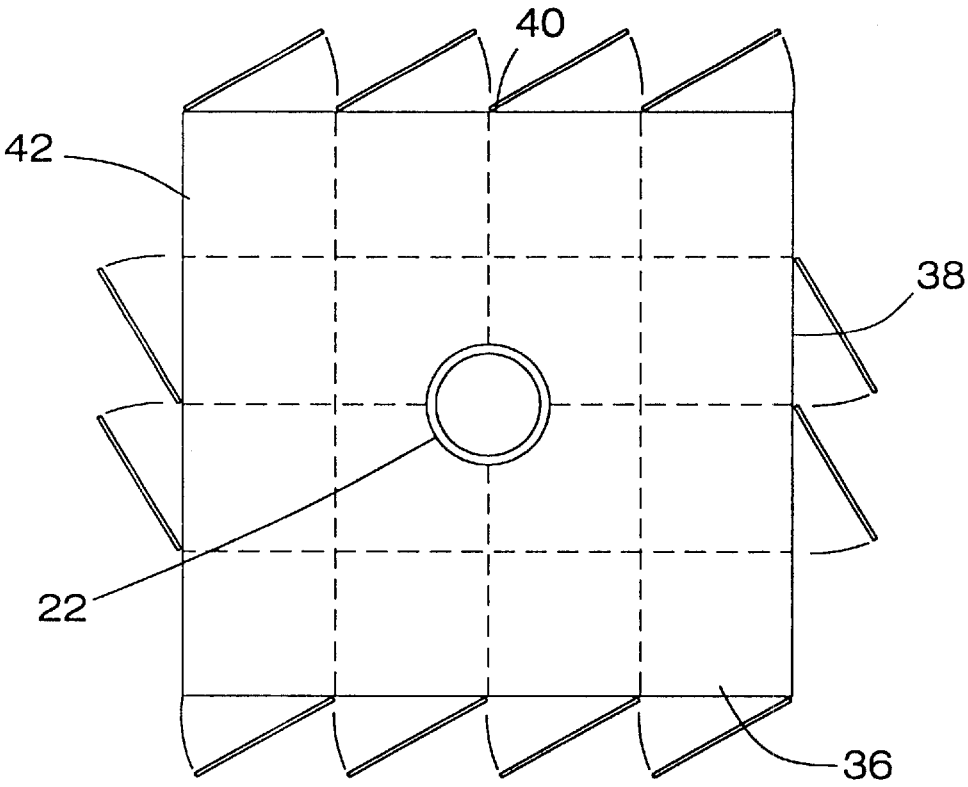
FIG. 2 is a schematic cross-sectional view taken along line 2—2 of the present invention.
Figure 3:
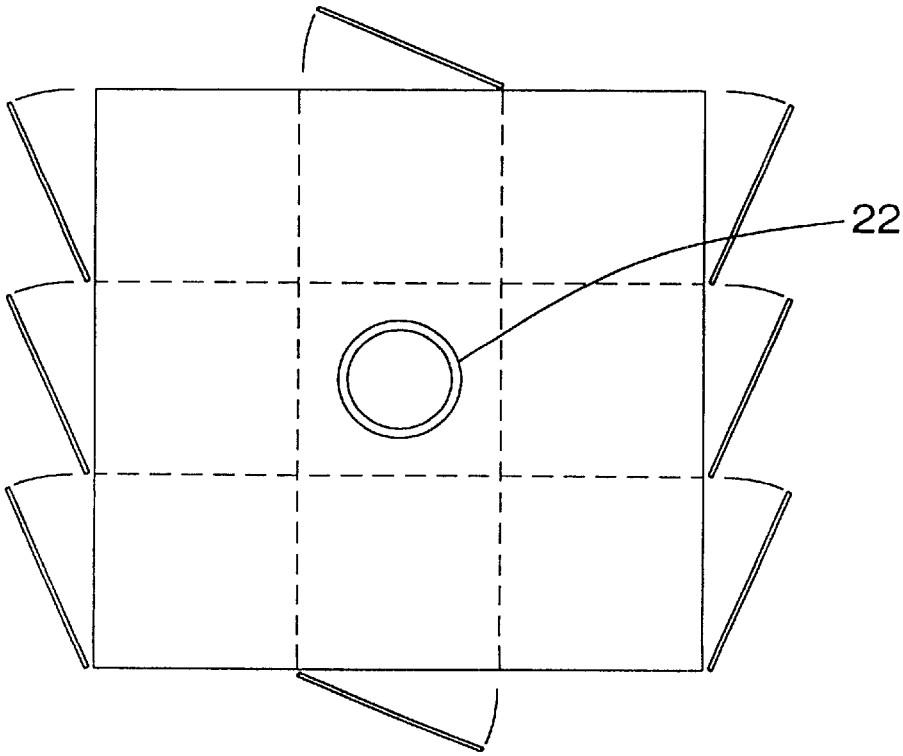
FIG. 3 is a schematic cross-sectional view taken along line 3—3 of the present invention.
Figure 4:
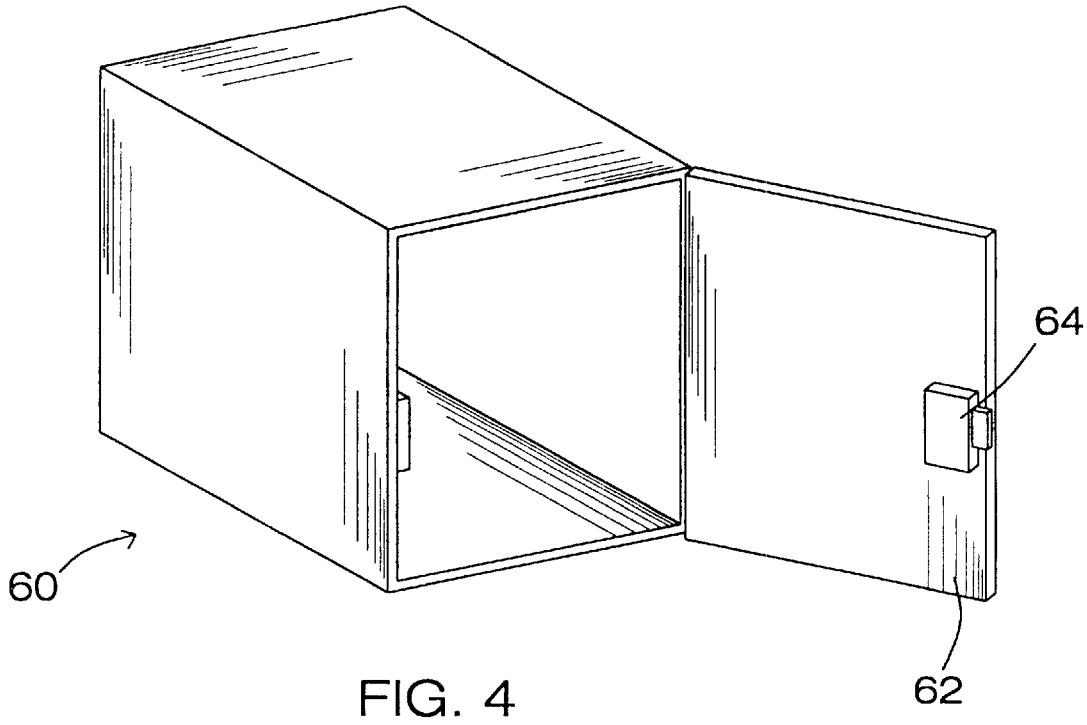
FIG. 4 is a schematic perspective view of a compartment of the present invention.
Figure 5:
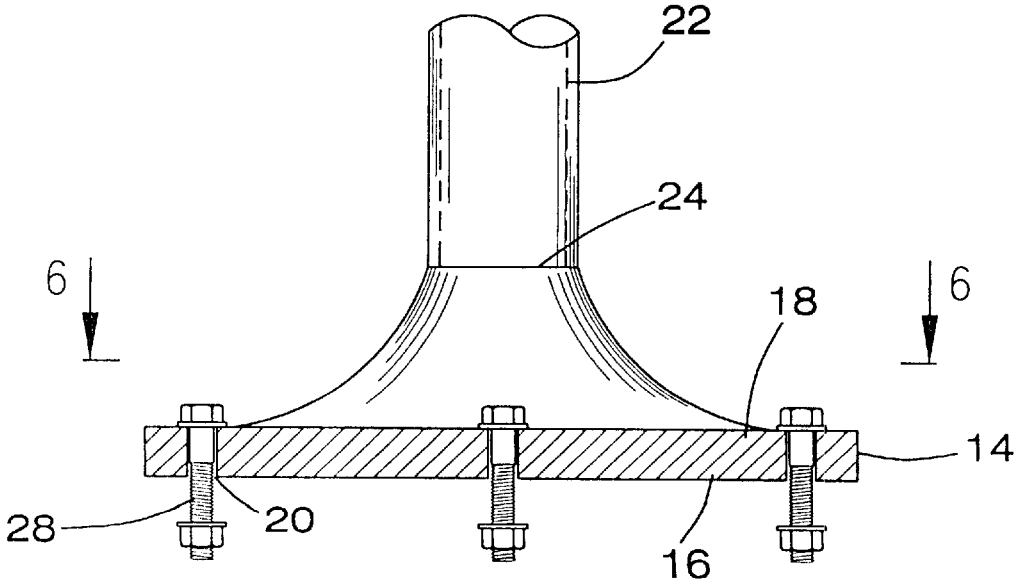
FIG. 5 is a schematic side broken view of the pedestal of the present invention.
Figure 6:
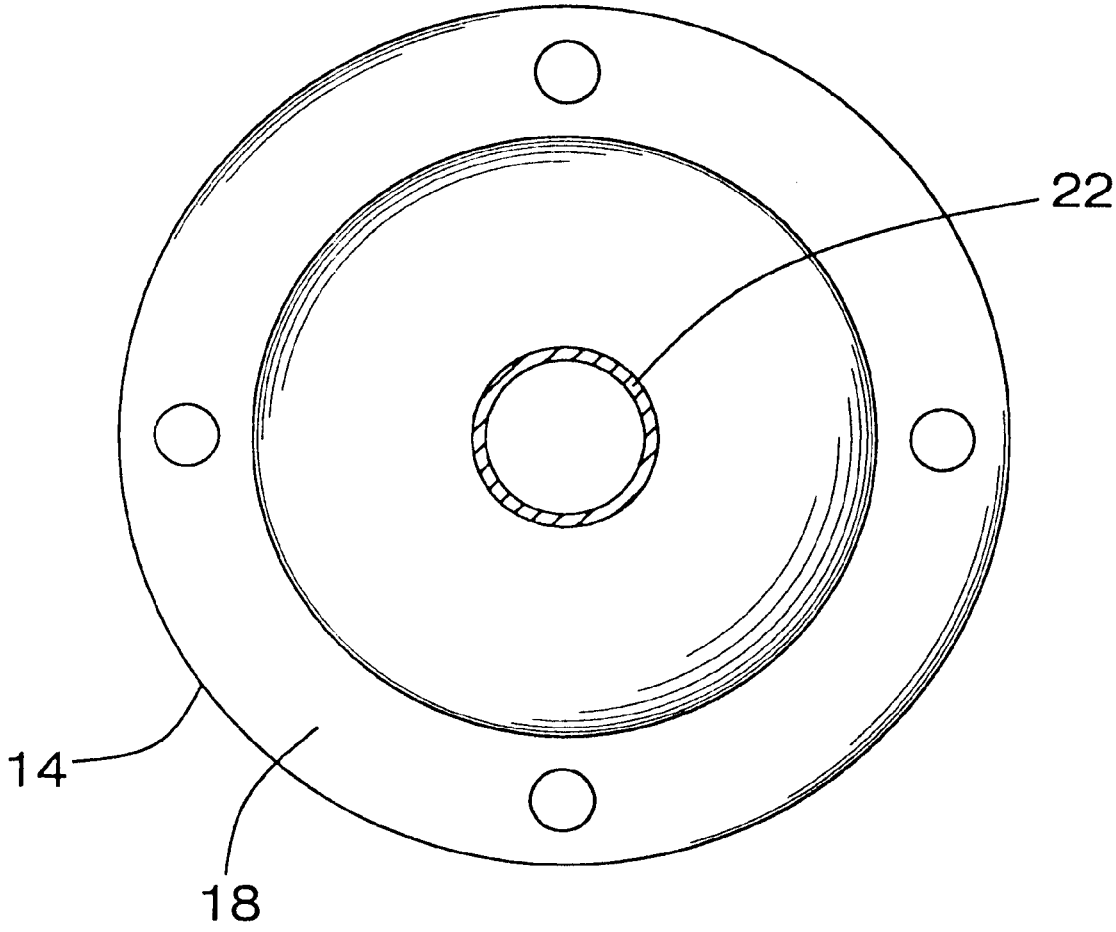
FIG. 6 is a schematic top view of the pedestal taken along line 6—6 of the present invention.

With reference now to the drawings, and in particular to FIGS. 1 through 6 thereof, a new storage locker device embodying the principles and concepts of the present invention and generally designated by the reference numeral 10 will be described.

As best illustrated in FIGS. 1 through 6, the storage locker device 10 generally comprises a pedestal and a housing coupled to the pedestal.

The pedestal 12 includes a base portion 14 having a bottom surface 16 and a top surface 18. The base portion 14 has a plurality of apertures 20 extending therethrough. A pole 22 is elongated and has a first end 24 and a second end 26. The first end 24 is pivotally coupled to the base portion 14 such that the pole 22 extends upwardly away from the base portion 14 in a generally vertical orientation. A plurality of securing means 28 removably secures the base portion 14 to a floor. Each of the securing means 28 ideally comprises a bolt and nut. Each of the bolts is extendable through one of the apertures 20.

A housing 30 is defined by a plurality of compartments 60 securely coupled together. The housing 30 has a top side 32, a bottom side 34, a first side 36, a second side 38, a third side 40, and a fourth side 42. The housing 30 is mounted on the pedestal 12. The pole 22 extends upwardly through a central portion of the bottom side 34 of the housing 30. The housing 30 is divided into a plurality of tiers 44. Each of the tiers 44 is comprised of a plurality of compartments 60 securely coupled together. A first 46 of the tiers abuts the top side 32 and a last of the tiers abuts the bottom side 34. The plurality of tiers 44 is seven tiers. The first 46, second 48, third 50, fourth 52 and fifth 54 tiers of the first 36 and third 40 sides have compartments 60 arranged in a 5 by 4 matrix. The first 46 through fifth 54 tiers of the second 38 and fourth 42 sides have compartments 60 arranged in a 5 by 2 matrix. The sixth 56 and seventh 58 tiers of the first 36 and third 40 sides have compartments 60 arranged in a 2 by 1 matrix. The sixth 56 and seventh 58 tiers of the second 38 and fourth 42 sides have compartments 60 arranged in a 2 by 3 matrix. Each of the compartments 60 positioned in the first 46 through fifth 54 tiers has a height and width preferably equal to 9 inches. Each of the compartments 60 positioned in the sixth 56 and seventh 58 tiers preferably has a height and width equal to 12 inches.

Each of the compartments 60 includes an outer wall 62 defining a door for providing access into the compartment. The door, or outer wall 62, is hingedly coupled to the compartment 60. A lock 64 selectively locks the door 62 in a closed position and is mechanically coupled to the door 62. A plate 66 is securely coupled to an outer surface of the door 62. Written indicia may be positioned on the plate 66 for distinguishing between the compartments.

In use, the device 10 is positioned in an area where people would want to store personal items such as keys and wallets. A user is given a key to one of the compartments 60 for unlocking the lock 64. Items are placed into the compartment 60 for retrieval at a later time.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. The storage locker apparatus comprising:

a housing being defined by a plurality of compartments securely coupled together, said housing having a top side, a bottom side, a first side, a second side, a third side, and a fourth side, said housing being divided into a plurality of tiers, each of said tiers being comprised of a plurality of compartments securely coupled together, each of said compartments comprising;

an outer wall defining a door for providing access into said compartment, said door being hingedly coupled to said compartment; and a lock for selectively locking said door in a closed position, said lock being mechanically coupled to said door;

wherein said plurality of tiers is seven tiers, the first through fifth tiers of said first and third sides having compartments arranged in a 5 by 4 matrix, the first through fifth tiers of said second and fourth sides having compartments arranged in a 5 by 2 matrix, the sixth and seventh tiers of said first and third sides having compartments arranged in a 2 by 1 matrix, the sixth and seventh tiers of said second and fourth sides having compartments arranged in a 2 by 3 matrix.

2. The storage locker apparatus as in claim 1, further comprising:

a pedestal, said housing being mounted on said pedestal.

3. The storage locker apparatus as in claim 2, wherein said pedestal comprises:

a base portion having a bottom surface and a top surface;

a pole, said pole being elongated and having a first end and a second end, said first end being pivotally coupled to said base portion such that said pole extends upwardly away from said base portion in a generally vertical orientation, said pole extending upwardly through a central portion of said bottom side of said housing.

4. The storage locker apparatus as in claim 1, wherein each of said compartments positioned in said first through fifth tiers having a height and width substantially equal to 9 inches, each of said compartments positioned in said sixth and seventh tiers having a height and width equal to 12 inches.

5. The storage locker apparatus as in claim 4, wherein each of said compartments further includes a plate coupled to an outer surface of said door.

6. The storage locker apparatus as in claim 1, wherein each of said compartments further includes a plate coupled to an outer surface of said door.

7. A storage locker apparatus, comprising:

a pedestal, said pedestal including;

a base portion having a bottom surface and a top surface, said base portion having a plurality of apertures extending therethrough;

a pole, said pole being elongated and having a first end and a second end, said first end being pivotally coupled to said base portion such that said pole extends upwardly away from said base portion in a generally vertical orientation;

a plurality of securing means for removably securing said base portion to a floor, each of said securing means comprising a bolt and nut, wherein each of said bolts is extendable through one of said apertures;

a housing being defined by a plurality of compartments securely coupled together, said housing having a top side, a bottom side, a first side, a second side, a third side, and a fourth side, said housing being mounted on said pedestal, said pole extending upwardly through a central portion of said bottom side, said housing being divided into a plurality of tiers, each of said tiers being comprised of a plurality of compartments securely coupled together, a first of said tiers abutting said the top side and a last of said tiers abutting said bottom side, said plurality of tiers being seven tiers, the first through fifth tiers of said first and third sides having compartments arranged in a 5 by 4 matrix, the first through fifth tiers of said second and fourth sides having compartments arranged in a 5 by 2 matrix, the sixth and seventh tiers of said first and third sides having compartments arranged in a 2 by 1 matrix, the sixth and seventh tiers of said second and fourth sides having compartments arranged in a 2 by 3 matrix, each of said compartments positioned in said first through fifth tiers having a height and width substantially equal to 9 inches, each of said compartments positioned in said sixth and seventh tiers having a height and width equal to 12 inches, each of said compartments comprising;

an outer wall defining a door for providing access into said compartment, said door being hingedly coupled to said compartment;

a lock for selectively locking said door in a closed position, said lock being mechanically coupled to said door; and a plate being securely coupled to an outer surface of said door, wherein written indicia may be positioned on said plate.

* * * * *